US007163274B2

(12) United States Patent
Chiao et al.

(10) Patent No.: US 7,163,274 B2
(45) Date of Patent: Jan. 16, 2007

(54) INKJET DISPENSING APPARATUS

(75) Inventors: Chia-Cheng Chiao, Guansi Township, Hsinchu County (TW); Shyh-Haur Su, Hsinchu (TW); Chien-Tsung Wu, Taichung (TW); Chiu-Neng Chen, Dasi Township, Taoyuan County (TW); Lung-Yu Hung, Nantou (TW)

(73) Assignees: Industrial Technology Research Institute, Hsinchu (TW); Phalanx Biotech Group, Inc., Taipei (TW)

( * ) Notice: Subject to any disclaimer, the term of this patent is extended or adjusted under 35 U.S.C. 154(b) by 241 days.

(21) Appl. No.: 10/747,491

(22) Filed: Dec. 29, 2003

(65) Prior Publication Data

US 2005/0140751 A1 Jun. 30, 2005

(51) Int. Cl.
*B41J 29/393* (2006.01)
*B41J 2/135* (2006.01)

(52) U.S. Cl. ..... 347/19; 347/44

(58) Field of Classification Search ..... 347/7, 347/19, 20, 23, 44, 56, 57, 63, 65, 71; 29/890.01
See application file for complete search history.

(56) References Cited

U.S. PATENT DOCUMENTS 5,343,064 A * 8/1994 Spangler et al. ..... 257/350
5,369,420 A * 11/1994 Bartky ..... 347/19
5,686,224 A * 11/1997 O'Neill ..... 430/320
5,943,080 A * 8/1999 Kubota et al. ..... 347/100
6,109,738 A * 8/2000 Miyata et al. ..... 347/71
6,315,853 B1 * 11/2001 Kubota et al. ..... 156/257
6,431,678 B1 * 8/2002 Beck et al. ..... 347/19
6,623,109 B1 * 9/2003 Mou et al. ..... 347/63
6,679,582 B1 * 1/2004 Silverbrook ..... 347/40

FOREIGN PATENT DOCUMENTS

JP 2004-58633 2/2004

OTHER PUBLICATIONS

Taiwan Office Action.

* cited by examiner

*Primary Examiner*—Anh T. N. Vo
(74) *Attorney, Agent, or Firm*—Thomas, Kayden, Horstemeyer & Risley

(57) ABSTRACT

An inkjet dispensing apparatus. The inkjet dispensing apparatus includes a cartridge, a chip, and a sensor controller. The cartridge includes a first channel and a second channel. The first channel has a first kind of liquid therein, and the second channel has a second kind of liquid therein. The chip is disposed on the cartridge, and includes a first conductor and a second conductor. The first conductor is in contact with the first kind of liquid, and the second conductor is in contact with the second kind of liquid. The sensor controller is coupled to the first conductor and the second conductor to detect leakage between the first channel and the second channel.

16 Claims, 6 Drawing Sheets

INKJET DISPENSING APPARATUS

BACKGROUND OF THE INVENTION

1. Field of the Invention

The invention relates to an inkjet dispensing apparatus with a multi-channel cartridge, and in particular, the invention relates to an inkjet dispensing apparatus able to detect leakage between channels thereof.

2. Description of the Related Art

Advances in industries employing chemical and biological processes have created a need for devices that accurately and automatically dispense small quantities of liquids containing chemically or biologically active substances for commercial or experimental use. Accuracy and precision in the amount of liquid dispensed is important both from the standpoint of generating a desired reaction and minimizing the amount of material used. An example of a device with an array of reagents disposed thereupon is a biochip.

From the standpoint of reliability, it is important to prevent different reagents from intermixing during dispensing. In view of this, a multi-channel inkjet cartridge has been disclosed, preventing intermixing of different reagents during dispensing.

As well as during dispensing, intermixing of different reagents may occur due to the leakage in the inkjet printhead. For example, the leakage between different reagents may occur between the cartridge and the chip, between the chip and the barrier layer, or between the barrier layer and the nozzle plate. However, there is no leakage detection apparatus and method for an inkjet dispensing apparatus with a multi-channel inkjet cartridge.

U.S. Pat. No. 6,431,678 discloses an ink leakage detection apparatus. Referring to FIGS. 1*a*–1*b*, detectors 21 are formed around contact pads 22 such that the leakage of ink onto both the detector 21 and power or control lines 23 causes a voltage to be propagated through the conductive ink to the detector 21. The detector 21 is in turn coupled to the detection circuit which outputs an ink leakage signal upon receipt of a voltage from a power or a control line 24 or other source. Thus, leakage is detected. It is understood that the inkjet print head 20 includes a substrate 25, a barrier layer 26, and a nozzle plate 27.

Although the apparatus disclosed in U.S. Pat. No. 6,431,678 can detect leakage in some inkjet print heads, it is not applicable to an inkjet dispensing apparatus with a multi-channel inkjet cartridge. Specifically, the detection apparatus shown in FIGS. 1*a*–1*b* cannot determine which channel is leaking, and cannot detect leakage between the inkjet cartridge and the chip.

SUMMARY OF THE INVENTION

In view of this, the invention provides an inkjet dispensing apparatus with the capability to detect leakage between channels therein. Another purpose of the invention is to provide a method for manufacturing a structure for an inkjet printhead that can conveniently detect leakage.

Accordingly, the invention provides an inkjet dispensing apparatus including a cartridge, a chip, and a sensor controller. The cartridge includes a first channel and a second channel. The first channel has a first kind of liquid therein, and the second channel has a second kind of liquid therein. The chip is disposed on the cartridge, and includes a first conductor and a second conductor. The first conductor is in contact with the first kind of liquid, and the second conductor is in contact with the second kind of liquid. The sensor controller is coupled to the first conductor and the second conductor to detect leakage between the first channel and the second channel.

In a preferred embodiment, the inkjet dispensing apparatus includes a first terminal and a second terminal. The first terminal is coupled to the first conductor such that the sensor controller is, in turn, coupled to the first conductor via the first terminal.

The second terminal is coupled to the second conductor such that the sensor controller is, in turn, coupled to the second conductor via the second terminal.

In another preferred embodiment, the chip further includes an isolation layer and a conductive layer. The isolation layer includes a plurality of contact holes, the first conductor and the second conductor are disposed on the isolation layer. The isolation layer is disposed on the conductive layer. The first conductor and the second conductor are in contact with the conductive layer via the contact holes.

It is noted that the isolation layer may include SiN and SiC, the conductive layer may be Al, and the first s conductor and the second conductor may be Ta. Additionally, the conductive layer is coupled to the sensor controller such that the first conductor and the second conductor are, in turn, coupled to the sensor controller via the conductive layer.

Furthermore, the chip further includes an actuator. The actuator may be a heating layer made of TaAl.

In another preferred embodiment, the inkjet dispensing apparatus further includes a barrier layer and a nozzle plate. The barrier layer is disposed on the chip. The nozzle plate is disposed on the barrier layer, and includes a plurality of orifices communicating with the first channel and the second channel respectively.

It is noted that the nozzle plate may be polyimide, and the chip may be glass. Alternatively, the chip may be silicon, and includes an electric-isolating layer therein.

In another preferred embodiment, the sensor controller includes a voltage supply device providing voltage to the first conductor and the second conductor. Alternatively, the sensor controller may be a multimeter.

In the invention, a method for manufacturing a structure for an inkjet printhead is provided. The method includes the following steps. A substrate is provided. An actuating layer is formed on the substrate. A conductive layer is formed on the actuating layer. An isolation layer is formed on the conductive layer, and includes a plurality of contact holes therein. A plurality of conductors are formed on the isolation layer, and coupled to the conductive layer via the contact holes.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1A:
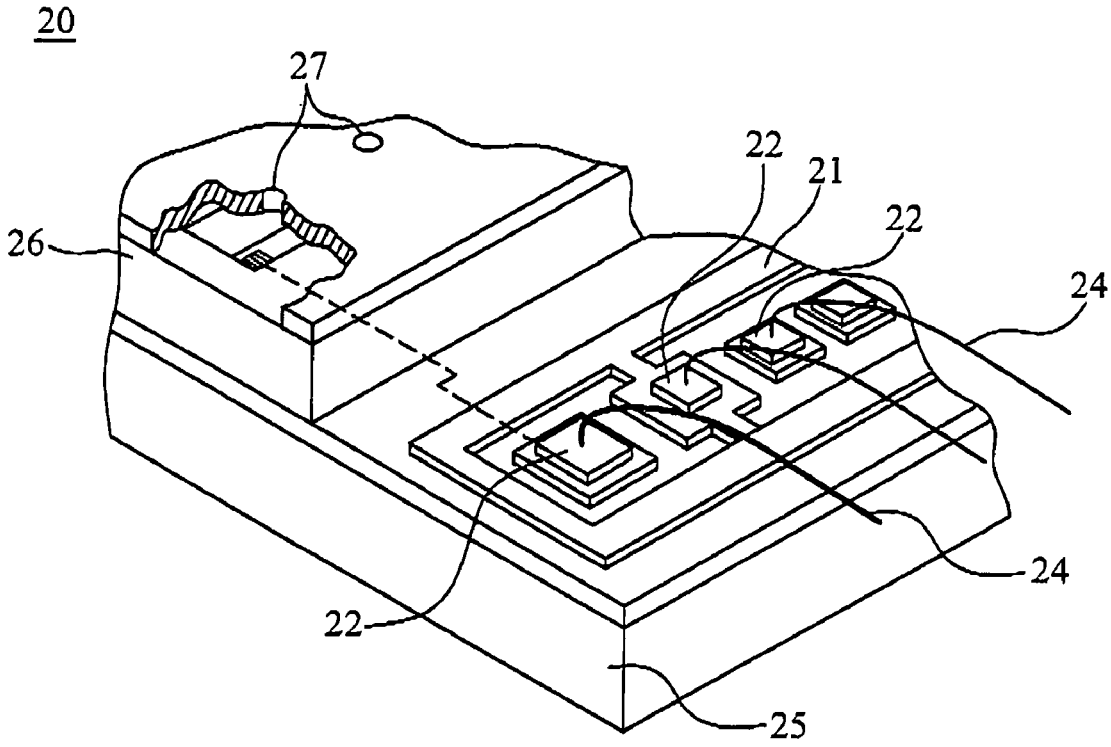
FIG. 1a (RELATED ART)
FIG. 1*a* is a partial cutaway isometric view of an inkjet printhead as disclosed in U.S. Pat. No. 6,431,678.
Figure 1B:
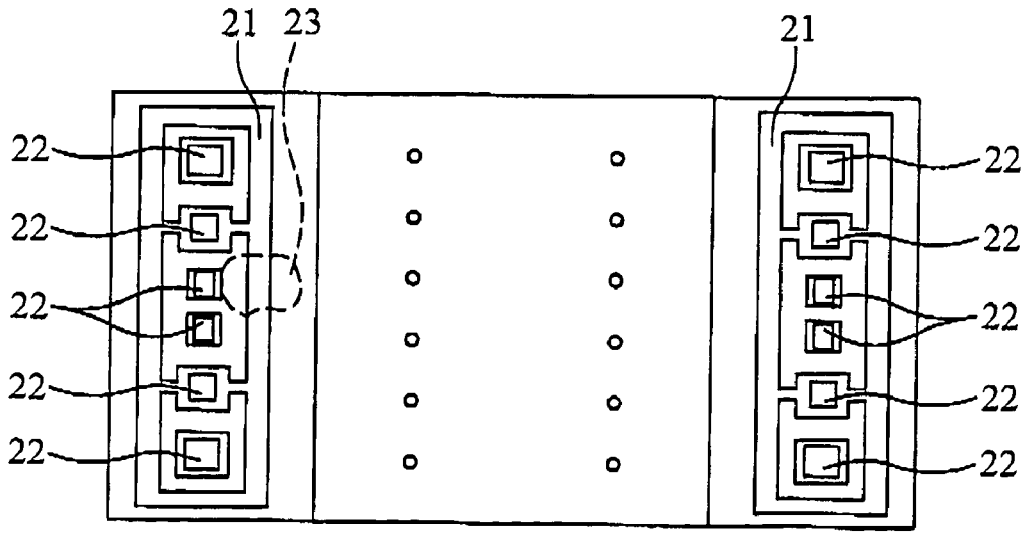
FIG. 1b (RELATED ART)
FIG. 1*b* is a top view of the inkjet print head in FIG. 1*a;*
Figure 2A:
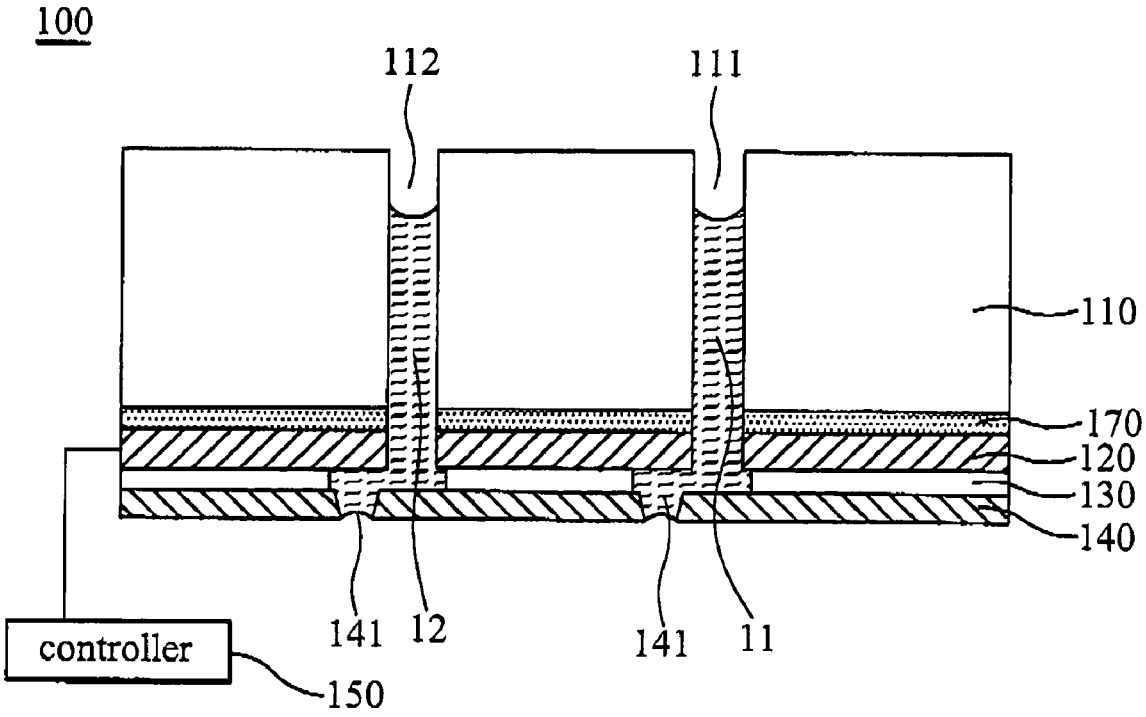
FIG. 2*a* is a schematic view showing an inkjet dispensing apparatus as disclosed in the invention.
Figure 2B:
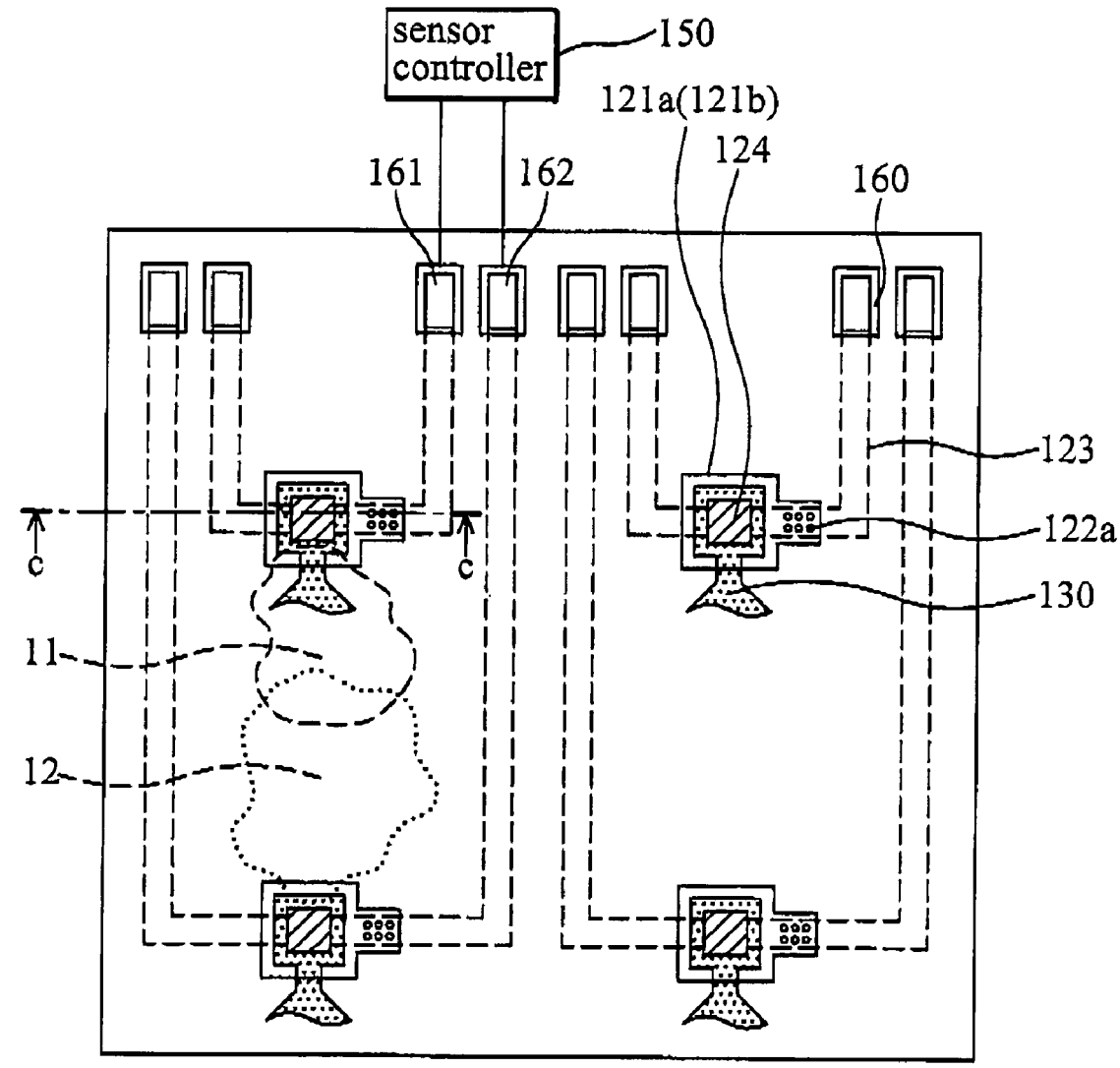
FIG. 2*b* is a plane view of an inkjet dispensing apparatus in FIG. 2*a;*
Figure 2C:
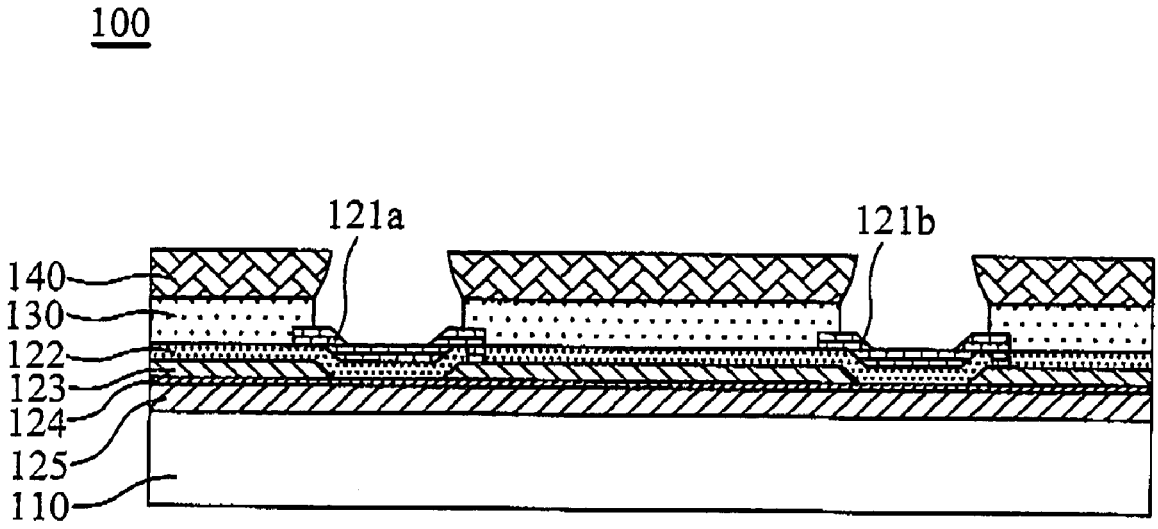
FIG. 2*c* is a cross section along a line c—c in FIG. 2*b;*.

Referring to FIGS. 2*a*–2*c*, an inkjet dispensing apparatus 100 as disclosed in the invention is provided. The inkjet dispensing apparatus 100 includes a cartridge 110, a chip 120, a barrier layer 130, a nozzle plate 140, a sensor controller 150, and a plurality of terminals 160.

The cartridge 110 includes a plurality of channels 111, 112 therein. It is noted that only two channels are shown in FIG. 2*a*, one referred to as a first channel 111 and the other referred to as a second channel 112. Different kinds of liquid are received in the different channels respectively. For example, as shown in FIG. 2*a*, the first channel 111 has a first kind of liquid 11 therein, and the second channel 112 has a second kind of liquid 12 therein.

Figure 3A:
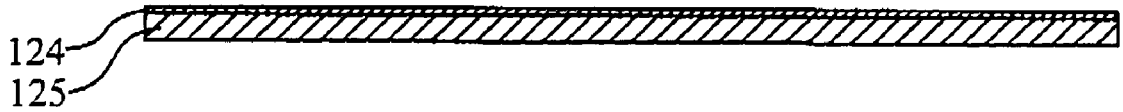
FIGS. 3*a*–3*d* are schematic views of a method for manufacturing a structure for an inkjet printhead as disclosed in the invention.
Figure 3B:
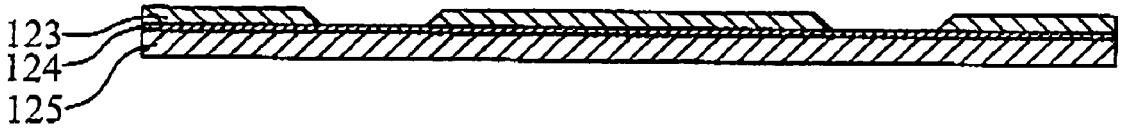
Figure 3C:
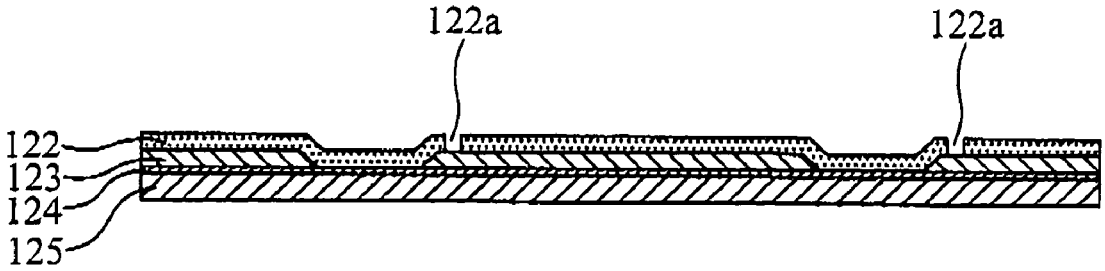
Figure 3D:
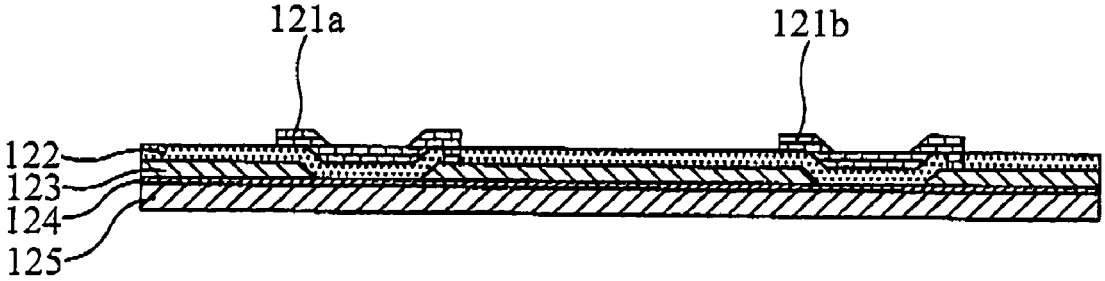

The chip 120 is disposed on the cartridge 110 via glue 170, and includes a plurality of conductors 121*a*, 121*b*, an isolation layer 122, a conductive layer 123, an actuating layer 124, and a substrate 125. Specifically, referring to FIGS. 3*a*–3*d*, a method for manufacturing the chip 120 is described. As shown in FIG. 3*a*, the substrate 125 is provided, and the actuating layer 124 is formed on the substrate 125. The conductive layer 123 is then formed on the actuating layer 124, and is shaped as shown in FIG. 3*b*. The isolation layer 122 is then formed on the conductive layer 123, and includes a plurality of contact holes 122*a* therein as shown in FIG. 3*c*. The conductors 121*a*, 121*b* are then formed on the isolation layer 122, and are coupled to the conductive layer 123 via the contact holes 122*a* as shown in FIG. 3*d*.

The conductors 121*a*, 121*b* protect the chip 120 during dispensing. It is noted that only two conductors are illustrated in FIG. 2*c*, one referred to as a first conductor 121*a* and the other referred to as a second conductor 121*b*. Each of the conductors is in contact with one kind of liquid respectively. For example, the first conductor 121*a* may be in contact with the first kind of liquid 11, and the second conductor 121*b* may be in contact with the second kind of liquid 12. Additionally, the conductors 121*a*, 121*b* may be Ta.

The isolation layer 122 may include SiN and SiC. The conductive layer 123 is coupled to the terminals 160, and may be Al. The actuating layer 124 is used as an actuator to generate a bubble to dispense the liquid, and may be a heating layer made of TaAl. The substrate 125 may be glass, or may be silicon and includes an electric-isolating layer therein.

As shown in FIG. 2*a*, the barrier layer 130 is disposed on the chip 120. The nozzle plate 140 is disposed on the barrier layer 130, and includes a plurality of orifices 141 communicating with the first channel 111 and the second channel 112 respectively. It is noted that the nozzle plate 140 may be polyimide.

It is understood that the liquid, flowing from the cartridge 110 to the chip 120, is stored in the barrier layer 130 as shown in FIG. 2*b*.

The sensor controller 150 is detachably coupled to the conductors 121*a*, 121*b* via the terminals 160 to detect leakage between the channels 111, 112. For example, the sensor controller 150 may include a voltage supply device providing voltage to the conductors 121*a*, 121*b*. Alternatively, the sensor controller 150 may be a multimeter.

Each of the terminals 160 is disposed on the chip 120, and is coupled to the conductors 121*a*, 121*b* via the conductive layer 123 respectively. Additionally, each of the terminals 160 can be coupled to the sensor controller 150 so that the sensor controller 150 can provide voltage to the conductors 121*a*, 121*b*. For example, one of the terminals may be referred to as a first terminal 161, and the other one may be referred to as a second terminal 162. The first terminal 161 is coupled to the first conductor 121*a* such that the sensor controller 150 is, in turn, coupled to the first conductor 121*a* via the first terminal 161. The second terminal 162 is coupled to the second conductor 121*b* such that the sensor controller 150 is, in turn, coupled to the second conductor 121*b* via the second terminal 162.

The structure of the inkjet dispensing apparatus is described above, and the method for detecting leakage between the channels of the inkjet dispensing apparatus follows.

To detect leakage, the sensor controller 150 is coupled to any two of the terminals 160 at a time until all the terminals 160 are checked. For example, the sensor controller 150 may be coupled to the first terminal 161 and the second terminal 162. The sensor controller 150 then provides voltage to the first conductor 121*a* and the second conductor 121*b* via the first terminal 161 and the second terminal 162. In a normal situation, the detected value of the resistance between the first conductor 121*a* and the second conductor 121*b* is extremely high and cannot be measured since the first channel 111 and the second channel 112 are independent of each other. When leakage occurs between the first channel 111 and the second channel 112, the resistance value or the current value can be measured by s the sensor controller 150 since the first conductor 121*a* is coupled to the second conductor 121*b* via the liquid 11, 12.

By the apparatus and the method of the invention, leakage between the channels of the inkjet printhead can be detected, thus preventing reagents from intermixing. In addition, the leakage position can be accurately located to maintain the reliability of the inkjet printhead. Moreover, unlike conventional leakage detection apparatus, leakage between the cartridge and the chip of the inkjet dispensing apparatus can be detected.

While the invention has been described by way of example and in terms of the preferred embodiment, it is to be understood that the invention is not limited to the disclosed embodiment. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inkjet dispensing apparatus comprising:

a cartridge including a first channel and a second channel, wherein the first channel has a first kind of liquid therein, and the second channel has a second kind of liquid therein;

a chip, disposed on the cartridge, including a first conductor and a second conductor, wherein the first conductor is in contact with the first kind of liquid, and the second conductor is in contact with the second kind of liquid; and a sensor controller, coupled to the first conductor and the second conductor, to detect leakage between the first channel and the second channel, wherein the sensor controller is a multimeter.

2. The inkjet dispensing apparatus as claimed in claim 1, further comprising:

a first terminal coupled to the first conductor such that the sensor controller is, in turn, coupled to the first conductor via the first terminal; and a second terminal coupled to the second conductor such that the sensor controller is, in turn, coupled to the second conductor via the second terminal.

3. The inkjet dispensing apparatus as claimed in claim 1, wherein the chip farther comprises;

an isolation layer, including a plurality of contact holes, upon which the first conductor and the second conductor are disposed; and a conductive layer upon which the isolation layer is disposed, wherein the first conductor and the second conductor are coupled to the conductive layer via the contact holes.

4. The inkjet dispensing apparatus as claimed in claim 3, wherein the isolation layer comprises SiN and SiC.

5. The inkjet dispensing apparatus as claimed in claim 3, wherein the conductive layer comprises Al.

6. The inkjet dispensing apparatus as claimed in claim 3, wherein the conductive layer is coupled to the sensor controller such that the first conductor and the second conductor are, in turn, coupled to the sensor controller via the conductive layer.

7. The inkjet dispensing apparatus as claimed in claim 1, wherein the chip further comprises an actuator therein.

8. The inkjet dispensing apparatus as claimed in claim 7, wherein the actuator is a heating layer comprising TaAl.

9. The inkjet dispensing apparatus as claimed in claim 1, wherein the first conductor and the second conductor comprises Ta.

10. The inkjet dispensing apparatus as claimed in claim 1, further comprising:

a barrier layer disposed on the chip; and a nozzle plate, disposed on the barrier layer, including a plurality of orifices communicating with the first channel and the second channel respectively.

11. The inkjet dispensing apparatus as claimed in claim 10, wherein the nozzle plate comprises polyimide.

12. The inkjet dispensing apparatus as claimed in claim 1, wherein the chip comprises glass.

13. The inkjet dispensing apparatus as claimed in claim 1, wherein the chip comprises silicon, and includes an electric-isolating layer therein.

14. The inkjet dispensing apparatus as claimed in claim 1, wherein the sensor controller includes a voltage supply device providing voltage to the first conductor and the second conductor.

15. An inkjet dispensing apparatus comprising:

a cartridge including a first channel and a second channel, wherein the first channel has a first kind of liquid therein, and the second channel has a second kind of liquid therein;

a chip, disposed on the cartridge, including:

a first conductor, wherein the first conductor is in contact with the first kind of liquid;

a second conductor, wherein the second conductor is in contact with the second kind of liquid;

an isolation layer, including a plurality of contact holes, upon which the first conductor and the second conductor are disposed;

a conductive layer upon which the isolation layer is disposed, wherein the first conductor and the second conductor are coupled to the conductive layer via the contact holes; and a sensor controller, coupled to the first conductor and the second conductor, to detect leakage between the first channel and the second channel, wherein the conductive layer is coupled to the sensor controller such that the first conductor and second conductor are, in turn, coupled to the sensor controller via the conductive layer.

16. An inkjet dispensing apparatus comprising:

a cartridge including a first channel and a second channel, wherein the first channel has a first kind of liquid therein, and the second channel has a second kind of liquid therein;

a chip, disposed on the cartridge, including a first conductor and a second conductor, wherein the first conductor is in contact with the first kind of liquid, and the second conductor is in contact with the second kind of liquid;

a sensor controller, coupled to the first conductor and the second conductor, to detect leakage between the first channel and the second channel;

a barrier layer disposed on the chip; and a nozzle plate, disposed on the barrier layer, including a plurality of orifices communicating with the first channel and the second channel respectively, wherein the nozzle plate comprises polyimide.

* * * * *